US007030729B2

(12) United States Patent
Albanesi et al.

(10) Patent No.: US 7,030,729 B2
(45) Date of Patent: Apr. 18, 2006

(54) ELECTROMECHANICAL SAFETY FOR WEAPONS, AND WEAPON PROVIDED WITH THE SAME

(76) Inventors: Luciano Albanesi, Via Nomentana, 857, Roma (IT) I-00137; Benedetto Ottavi, Via delle Mimose, 36B, Tor Lupara di Mentana (IT) I-00013

( * ) Notice: Subject to any disclaimer, the term of this patent is extended or adjusted under 35 U.S.C. 154(b) by 471 days.

(21) Appl. No.: 10/203,921

(22) PCT Filed: Feb. 13, 2001

(86) PCT No.: PCT/IT01/00062

§ 371 (c)(1),
(2), (4) Date: Nov. 18, 2002

(87) PCT Pub. No.: WO01/61268

PCT Pub. Date: Aug. 23, 2001

(65) Prior Publication Data

US 2003/0136042 A1 Jul. 24, 2003

(30) Foreign Application Priority Data

Feb. 16, 2000 (IT) ..... RM2000A0076

(51) Int. Cl.
*G05B 19/00* (2006.01)

(52) U.S. Cl. ..... 340/5.61; 340/5.1; 340/5.2; 340/5.6; 340/825.69; 340/825.72; 340/10.1; 42/70.11; 42/70.04; 42/70.05; 42/70.06; 42/70.07

(58) Field of Classification Search ..... 340/5.61, 340/5.1, 5.2, 5.6; 42/70.11, 70.06, 70.07
See application file for complete search history.

(56) References Cited

U.S. PATENT DOCUMENTS

| | | | | |
|---|---|---|---|---|
| 4,488,370 | A | 12/1984 | Lemelson | |
| 5,168,114 | A * | 12/1992 | Enget | 42/70.01 |
| 5,793,324 | A * | 8/1998 | Aslanidis et al. | 342/51 |
| 5,896,691 | A * | 4/1999 | Kaminski et al. | 42/70.11 |
| 6,215,982 | B1 * | 4/2001 | Trompower | 455/63.3 |
| 6,282,829 | B1 * | 9/2001 | Mossberg et al. | 42/70.11 |
| 6,320,514 | B1 * | 11/2001 | Flick | 340/825.69 |
| 6,496,876 | B1 * | 12/2002 | Rohwer | 710/3 |
| 6,828,902 | B1 * | 12/2004 | Casden | 340/10.3 |

* cited by examiner

*Primary Examiner*—Brian Zimmerman
*Assistant Examiner*—Vernal Brown
(74) *Attorney, Agent, or Firm*—Young & Thompson

(57) ABSTRACT

An electromechanical safety for weapons (1), provided with a mechanical safety device, includes a base electronic unit, actuating an electromechanical transducer (2) acting on the safety mechanical device, and a transponder (5), the base unit providing a central control and processing unit, connected with a transceiver unit (4), continuously transmitting an enquiry signal, able to talk with the transponder (5), when the latter is within the transmission range of the transceiver unit (4), the transponder (5) having no power supply and receiving the power necessary to its operation from the signal transmitted by the transceiver unit (4), said at least one transponder (5) transmits, an identification code and the base unit actuates the electromechanical transducer (2) in such a way to release the safety mechanical device when receives an identification code corresponding to a code stored in the base unit and actuating the electromechanical transducer (2) in such a way to insert the safety mechanical device as soon as the base unit no more receives the identification code.

21 Claims, 3 Drawing Sheets

ELECTROMECHANICAL SAFETY FOR WEAPONS, AND WEAPON PROVIDED WITH THE SAME

The present invention relates to an electromechanical safety for weapons, and to a weapon provided with the same.

More specifically, the electromechanical safety allows, on the basis of the recognition of a specific code, the fast insertion or releasing of a safety, thus being easily usable, highly reliable and efficient.

It is known that present weapons are provided with safety devices allowing their controlled use. Particularly for personal use weapons, either for private citizens or for police, it is provided the use of mechanical safeties that, when inserted, disable its operation. Usually, to insert or release said mechanical safeties it is necessary for the user to apply a remarkable force on elements having reduced dimensions, said force being equal to the force necessary to the displacement of a mass of some hundreds grams, in order to prevent an accidental operation and to prevent the children from releasing said safeties.

However, said mechanical safeties have some drawbacks.

First of all, cases of accidental operation of the mechanical safeties can always occur, even if they are rare.

Further, also children can sometimes operate the safeties, thus causing very dangerous situations.

Finally, present fast operation mechanical safeties do not prevent their releasing by a user different from the authorised owner. This creates very dangerous situations, e.g. in case of fight between the weapon owner and an aggressor, for example during the standard police activity, when the weapon, slipping out of the owner policeman, can be taken and used by the aggressor against the same policeman. Similar situations occur, for example, in case of a theft in the house of a weapon owner, or in case of unauthorised appropriation of the weapon by a parent or acquaintance of the owner.

Solutions providing the adoption of mechanical safeties of the lock kind, are not very useful since their operation is extremely slow and do not solve the mentioned drawbacks with respect to a fight between the owner and the aggressor.

In this situation, it is included the solution suggested according to the present invention, allowing to reduce all the above mentioned problems.

Therefore, it is object of the present invention to allow in a simple, reliable and efficient way the fast insertion and releasing of a weapon safety, the releasing being allowed only to authorised users.

It is therefore specific object of the present invention an electromechanical safety for weapons, provided with a mechanical safety device, comprising a base electronic unit, actuating an electromechanical transducer acting on the safety mechanical device, and at least a transmitter-responder, or transponder, the base unit providing a central control and processing unit, preferably comprising a microprocessor, connected with a transceiver unit, continuously transmitting an enquiry signal, able to talk with said at least one transponder, when the latter is in the transmission range of the transceiver unit, said at least one transponder having no power supply and receiving the power necessary to its operation from the signal transmitted by the transceiver unit, said at least one transponder transmitting, when supplied, an identification code, the base unit actuating the electromechanical transducer in such a way to release the safety mechanical device when receives an identification code corresponding to a code stored in the base unit and actuating the electromechanical transducer in such a way to insert the safety mechanical device as soon as the base unit no more receives said identification code.

Preferably, according to the invention, the electromechanical transducer comprises a ratio-motor, operated by the base unit, interacting with a mechanical reduction gear acting on the safety mechanical device by a shaped cam movable between two limit positions, corresponding to the insertion and the releasing of the mechanical safety device, said two limit positions being respectively revealed by two corresponding limit microswitches disabling the supply of the ratio-motor.

Always according to the invention, the base electronic unit can be also provided with one or more supply batteries, preferably rechargeable batteries.

Still according to the invention, the base electronic unit can be further provided with acoustic and/or visual signalling devices, preferably with a light signalling device comprising one or more light emitting diodes, or LED.

Preferably, according to the invention, the transmission range of the transceiver unit has a maximum extension not larger than 15 cm.

It is further object of the present invention a weapon providing said electromechanical safety.

Further features and embodiments of the invention are described in the depending claims.

The present invention will be now described, for illustrative but not limitative purposes, according to its preferred embodiments, with particular reference to the figures of the enclosed drawings, wherein.

The electromechanical safety according to the invention allows the recognition of an authorised user of the weapon on which it is provided. Said authorised user is identified by recognising an identification code allowing the releasing of a standard mechanical safety device, usually comprised of a lever. Said mechanical device can be provided on the hammer, on the trigger or on any other element of the weapon able to disable its operation. Safety provides an electronic circuitry, operating an electromechanical transducer acting on the mechanical safety device, realising a passive radiofrequency communication between a base unit and a transmitter—responder, or transponder, without power supply, receiving the necessary power for its operation directly from the base unit and talking with the latter, providing its identification code.

Figure 1:
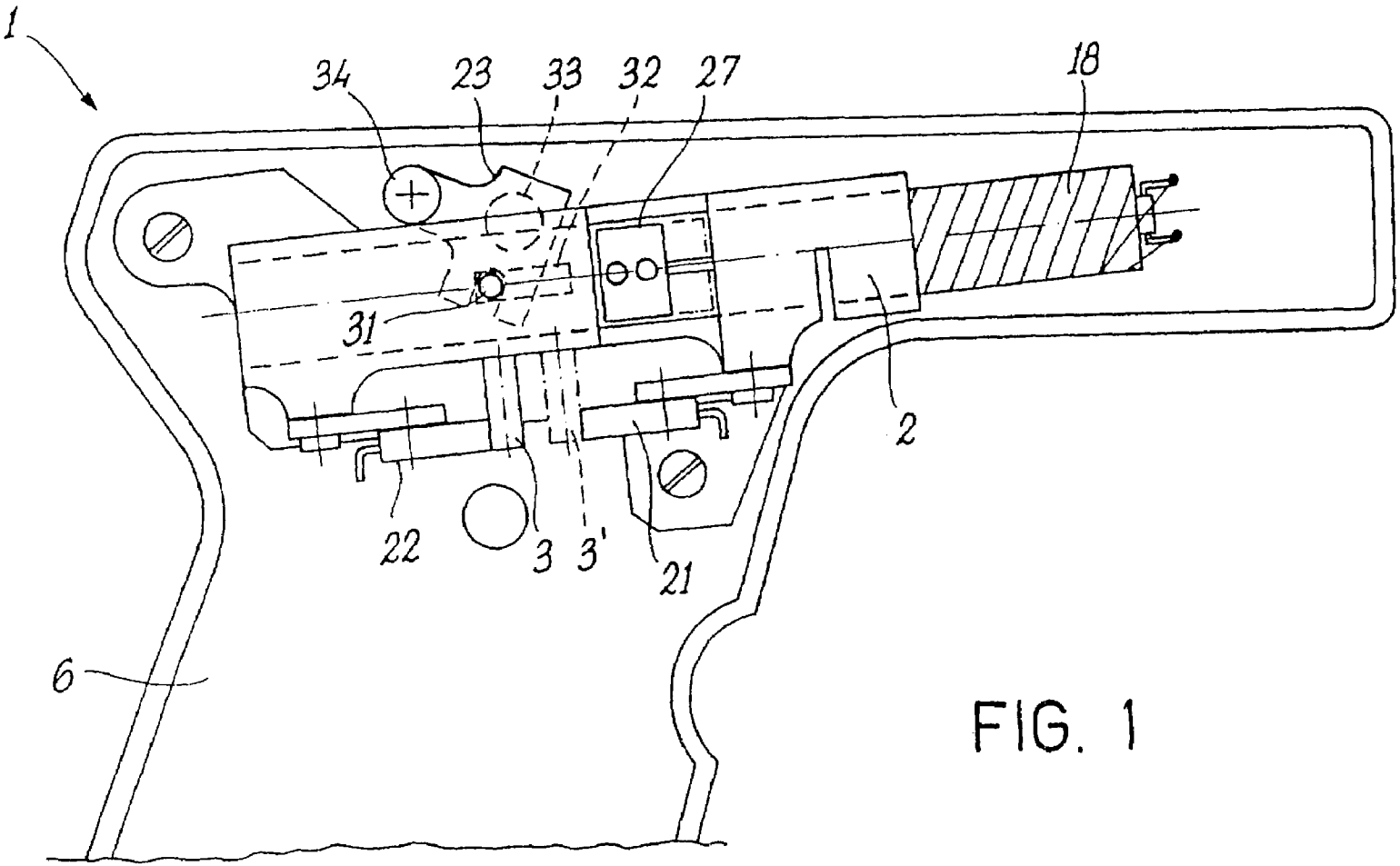
FIG. 1 is a partial lateral view, with the inner elements that are visible, of a gun provided with a safety according to the invention.

Making reference to FIG. 1, concerning the application of a preferred embodiment of the safety according to the invention on a gun 1, that is only partially shown, it can be noted that the safety according to the invention comprises an electromechanical transducer 2, operating on a standard safety mechanical device, not shown, by a shaped cam 23, movable between two limit positions: a first position corresponding to the insertion of the mechanical safety device, and a second limit position, in correspondence of which the cam 23 is shown in FIG. 1, corresponding to the insertion of the safety mechanical device.

Figure 2:
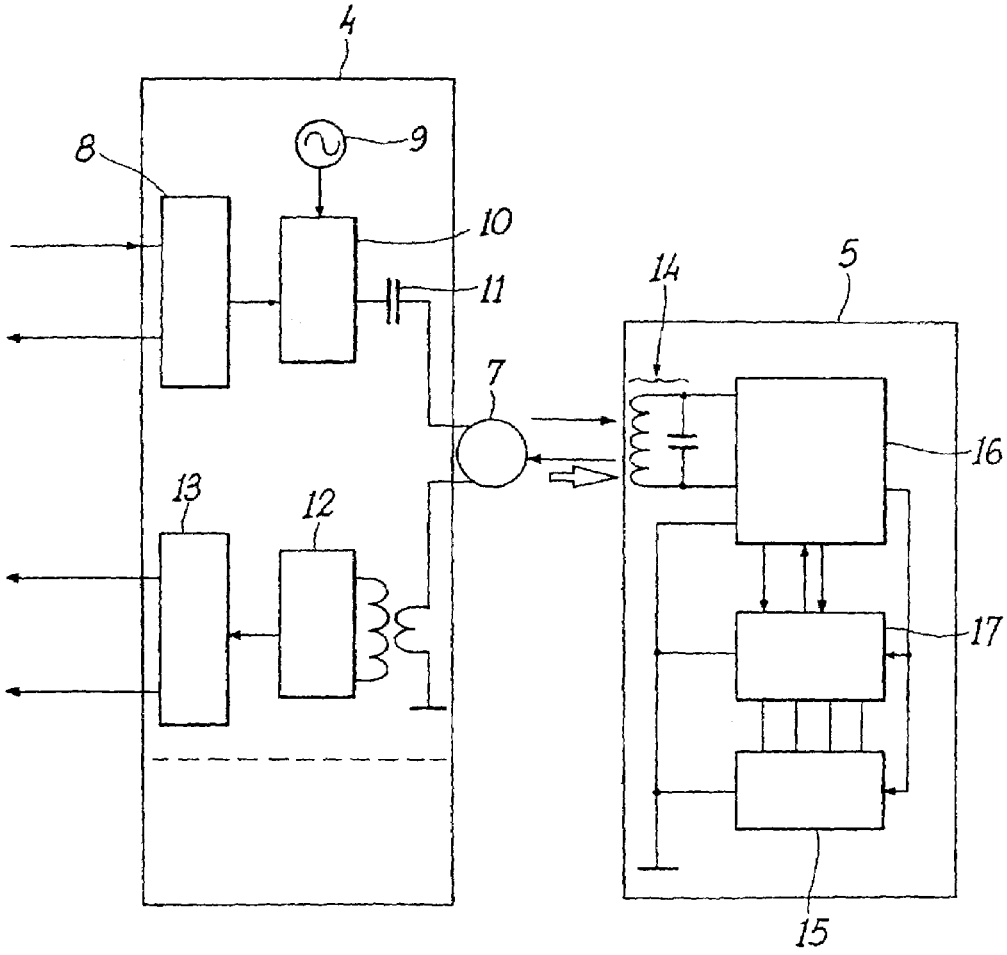
FIG. 2 shows a schematic diagram of communication electronic circuits of a safety according to the invention.

Making reference to FIG. 2, electromechanical transducer 2 is operated by the base unit, provided with a microprocessor, not shown, connected with a transceiver unit 4, when the base unit recognises the identification code received from a transponder 5 as a code authorised to the releasing of the safety mechanical device. Base unit is also provided with one or more supply batteries, not shown, preferably rechargeable, still more preferably nickel—metal hydride batteries, with a power switch, not shown, and with a light signalling device, comprising one or more light. emitting diodes, or LED, preferably with a plurality of colours, not shown as well. In the preferred embodiment, the base unit is housed within the gunstock 6 of the gun 1 and is provided with a single three colour LED. Preferably, the base unit is comprised of surface mounting components.

The transceiver unit 4 of the base unit provides an antenna 7 connected with a transmitter circuit and a receiver circuit.

The transmitter circuit comprises an encoder 8, receiving the signal to be transmitted by the microprocessor, the signal of which is mixed with the carrier wave, generated by an oscillator 9, in a modulator 10, the output signal of which is filtered by a low frequency blocking capacitor 11. In the preferred embodiment, the oscillator 9 generates a carrier wave having a frequency of 125 kHz.

The receiver circuit comprises a demodulator 12, tuned to the frequency of the carrier wave of the receive signal, which provides the modulating signal to a decoder 13 that sends the received code to the microprocessor.

The base unit talks with a transponder 5 comprising a resonant circuit 14, operating as transceiver antenna, and an electronically erasable and programmable read only memory unit 15, or EEPROM, wherein an identification code is stored. In the preferred embodiment, the EEPROM unit 15 has a capacity of 128 byte. Transponder 5 further comprises a contactless interface 16 that, exploiting the power of the signal received from the resonant circuit 14, acts as power supply for the transponder 5, provides the clock signal, which imposes the operation timing of the devices of the transponder 5, and operates as a signal modulator and demodulator. Lastly, the transponder comprises a unit 17 for controlling the access to the EEPROM unit 15, in order to carry out the reading and/or writing operations of the latter. Transponder 5 is advantageously inserted in a glove or, preferably, in a ring that can be put on by the gun 1 owner.

Base unit continuously transmits an enquiry signal in the environment surrounding the antenna 7. When the owner, wearing said ring or glove, holds the gun 1, transponder 5 enters within the transmission range of the base unit and transmits the identification code stored in the EEPROM unit 15. The microprocessor of the base unit analyses and recognises said code, actuating the electromechanical transducer 2, that releases the mechanical safety device of the gun 1, enabling its operation.

The base unit continuously enquiries the transponder 5 in such a way that, in case the latter is far from the transmission range of the base unit and can no more communicate with the former, the base unit actuates the electromechanical transducer 2, in such a way to reinstate the safety mechanical device.

One of the drawbacks that has been solved in realising the electromechanical safety according to the invention is that of limiting the consumption of the power necessary to release and to insert the safety mechanical device.

In fact, most diffused technology for this kind of uses provides an electromagnet excluding the safety mechanical device which is able to make a sufficient mechanical traction, corresponding to the traction necessary to displace a mass of some hundreds grams (usually 350 grams). Since the electromagnet requires a high current absorption, its use produces a fast discharge of the supply batteries of the base unit, thus making completely unreliable the safety of the gun 1.

Figure 3:
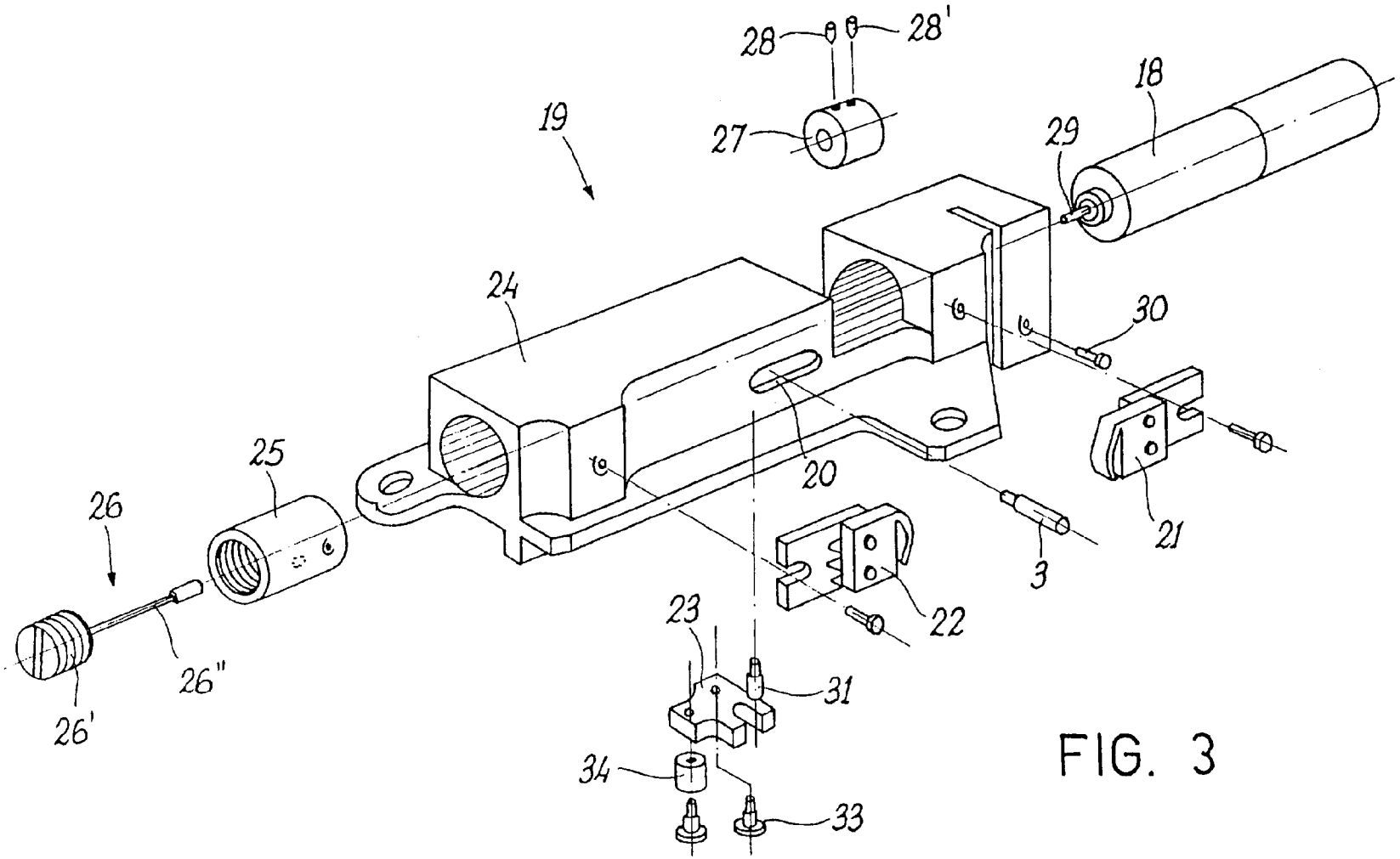
FIG. 3 shows an exploded perspective view of the mechanical transducer of the safety device of FIG. 1.

Making reference to FIG. 3, electromechanical transducer 2 used in the electromechanical safety device according to the invention comprises a ratio-motor 18, actuated by the base unit, interacting with a mechanical reduction gear 19, operating on the safety mechanical device, not shown, by the shaped cam 23 movable between two limit positions.

Particularly, mechanical reduction gear 19 comprises a body 24, within which the assembly comprised of a cylinder 25 and of a little cylinder 27 slides, said cylinder 25 having a special screw 26 screwed thereon, said screw 26 having threaded head 26' and axial stem 26", said little cylinder 27 having the point of the stem 26" partially inserted thereinto, said point being blocked by a first stop screw or grain 28. On the other side of the little cylinder 27, with respect to the stem 26", the slidable shaft 29 of the ratio-motor 18 is inserted, the latter being locked by a second grain 28'; ratio-motor 18 is blocked in its position by the screw 30. A pin 3 and a pin 31 are screwed, orthogonally with respect to one another, on the outer wall of the cylinder 25, and are movable within relevant slots 20 and 32 (slot 32 can be seen in broken line in FIG. 1); in this way, pin 3 and pin 31 are integral with the slidable shaft 29 of the ratio-motor 18. Shaped cam 23, rotating about the fulcrum 33, interacts with the pin 31, in such a way to act as a lever, at the end of the arm of which a roll 34 is fixed, that operates on the standard safety mechanical device, not shown.

Pin 3 is movable within the slot 20 between a first limit position, in correspondence of which, in FIG. 1, the pin is shown in broken line and indicated by the reference number 3', corresponding to the insertion of the safety mechanical device, and a second limit position, in correspondence of which, in FIG. 1, pin 3 is shown in solid line, corresponding to the releasing of the safety mechanical device. Said two limit positions are revealed by two corresponding limit microswitches, respectively indicated by reference numbers 21 and 22, disabling the supply of the ratio-motor 18.

Ratio-motor 18 preferably is a DC micro-motor, or a stepper micro-motor, or a rotative transducer.

Electromechanical transducer 2 allows to supply the ratio-motor 18 only for a very short time, thus prolonging the life time of the batteries that are constantly used only to provide the low supply current of the electronic devices of the base unit, just for few tens milliamperes. Preferably, electronic devices of the base unit are supplied with a voltage of 5 Volts.

In order to better understand the present invention, in the following operation modes of the preferred embodiment of the electromechanical safety are described, similar modes being valid also for other embodiments.

When the base unit is activated by turning on the power switch, the microprocessor carries out a control test of the proper operation of the devices, turns on the signalling LED with a first colour and starts transmitting an enquiry signal.

When the base unit recognises the identification code received from an authorised transponder 5, the microprocessor changes LED colour and actuates the micro-reduction gear 18 that, by the mechanical reduction gear 19, will release the standard safety mechanical device, thus enabling the gun to shot.

Until the transponder 5 remains within the transmission range of the base unit, gun 1 is activated and ready to shot.

When transponder 5 moves away from the base unit, until exiting from the transmission range, the base unit no more reads the authorised code and the microprocessor actuates the micro-reduction gear 18, making it rotating according to an opposite direction and reinstating the safety mechanical device.

When transponder 5 is within the transmission range of the base unit, even if the power switch is turned off, base unit does not turn off, since it could erroneously remain armed. Only when transponder 5 is moved away, micro-reduction gear 18 is operated in such a way to reinstate the safety mechanical device; to release it again, the power switch must be turned on and transponder 5 must move to the base unit.

In order to allow both the use of more than one transponder 5, having different codes for the same weapon, thus enabling more users, and the use of a single transponder 5 to release the safeties of more weapons, the base unit is able to learn more than one authorised identification code, preferably twenty codes. Particularly, the preferred embodiment of the electromechanical safety according to the invention provides a suitable programming transponder that, placed within the transmission range of the base unit, transmits a suitable learning code. The base unit, once received this code, remains waiting the new identification code to be stored, that is transmitted by the corresponding transponder 5 of the new user. The occurred storing of the new code is indicated by the LED, preferably by flashing.

In order to delete the stored codes from the base unit, the preferred embodiment of the electromechanical safety according to the invention provides a suitable cancellation transponder that, placed within the transmission range of the base unit, transmits a suitable cancellation code. Also the occurred cancellation of the memorised codes from the base unit is signalled by the LED.

The programming transponder and the cancellation transponder preferably have the shape of a PVV isocard or small PVC disk.

Steps described in the preceding for the programming and cancellation of the codes can also be carried out by one or more microswitches, to be maneuvered within the weapon.

The preferred embodiment of the electromechanical safety according to the invention provides that the batteries can be directly recharged within the weapon by a connector.

Preferably, the charge level of the batteries is continuously checked by the microprocessor and indicated by the LED. In order to prevent that, when the complete discharge of the batteries occurs, the weapon remains armed, the microprocessor activates a self-turning off circuit when it detects that the voltage of the batteries falls to a threshold value still sufficient for the operation of the base unit and of the mechanical transducer 2. Said self-turning off circuit actuates the micro-reduction gear 18 in such a way to reinsert the mechanical safety device, and then turns the base unit off.

The base unit can be also installed in different positions with respect to the one described, corresponding to the gunstock of the gun 1, taking into consideration also the possible use on different weapons, such as rifles or machine-guns.

Electromechanical safety according to the present invention can also be provided on already existing weapons.

For illustrative, but not limitative purposes, in case of a gun, it is possible to install a housing for the batteries under the barrel, eventually along with a tracking laser, while in a grip of the handle the base unit can be provided and in the other grip of the handle it can be provided the electromechanical transducer 2.

Mounting of the electromechanical safety can be easily carried out dismounting the original grips of the handle and replacing them with those respectively housing the base unit and the electromechanical transducer 2.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. Electromechanical safety apparatus for weapons (1), provided with a mechanical safety device, comprising a base electronic unit, actuating an electromechanical transducer (2) acting on the safety mechanical device, and at least a transmitter—responder, or transponder (5), the base unit providing a central control and processing unit, connected with a transceiver unit(4), continuously transmitting an enquiry signal, able to talk with said at least one transponder (5), when the latter is within the transmission range of the transceiver unit (4), said at least one transponder (5) having no power supply and receiving the power necessary to its operation from the signal transmitted by the transceiver unit (4), said at least one transponder (5) transmitting, when supplied, an identification code, the base unit actuating the electromechanical transducer (2) in such a way to release the safety mechanical device when receives an identification code corresponding to a code stored into the base unit and actuating the electromechanical transducer (2) in such a way to insert the safety mechanical device as soon as the base unit no more receives said identification code, wherein the electromechanical transducer (2) comprises a ratio-motor (18), operated by the base unit, interacting with a mechanical reduction gear (19) acting on the safety mechanical device by a shaped cam (23) movable between two limit positions, corresponding to the insertion and the releasing of the mechanical safety device, said two limit positions being respectively revealed by two corresponding limit microswitches (21, 22) disabling the supply of the ratio-motor (18).

2. Safety apparatus for weapons according to claim 1, characterised in that the ratio-motor (18) is a DC micro-motor, or a stepper micro-motor, or a rotative transducer.

3. Safety apparatus for weapons according to claim 1, characterised in that the base electronic unit is further provided with acoustic and/or visual signalling devices.

4. Safety apparatus for weapons according to claim 3, characterised in that said signalling devices provide a light signalling device comprising one or more light emitting diodes, or LED.

5. Safety apparatus for weapons according to claim 1, characterised in that the transceiver unit (4) of the base unit provides an antenna (7) connected with a transmitter circuit and a receiver circuit, the transmitter circuit comprising an encoder (8), receiving the signals to be transmitted by said control and processing unit, the signal of which is mixed with the carrier wave, generated by an oscillator (9), in a modulator (10), the output signal of which is filtered by a low frequency blocking capacitor (11), the receiver circuit comprising a demodulator (12), providing the modulating signal to a decoder (13), that sends the received code to said control and processing unit.

6. Safety apparatus for weapons according to claim 5, characterised in that the oscillator (9) generates a carrier wave having a frequency of 125 kHz.

7. Safety apparatus for weapons according to claim 1, characterised in that the base electronic unit is comprised of surface mounting components.

8. Safety apparatus for weapons according to claim 1, characterised in that the transmission range of the transceiver unit (4) has a maximum extension not larger than 15 cm.

9. Safety apparatus for weapons according to claim 1, characterised in that said at least one transponder (5) comprises a resonant circuit (14), operating as transceiver antenna, an electronically erasable and programmable read only memory unit (15), or EEPROM, wherein an identification code is stored, a contactless interface (16) that, exploiting power of the signal received from the resonant circuit (14), acts as power supply for the transponder (5), provides the clock signal, and operates as a signal modulator and demodulator, and a unit (17) for controlling the access to the EEPROM unit (15), in order to carry out the reading and/or writing operations of the latter.

10. Safety apparatus for weapons according to claim 9, characterized in that the EEPROM unit (15) has a capacity of 128 byte.

11. Safety apparatus for weapons according to claim 1, characterised in that each transponder (5) is inserted in a ring or in a glove.

12. Safety apparatus for weapons according to claim 1, characterised in that said base electronic unit is adapted to store more than one authorised identification code.

13. Safety apparatus for weapons according to claim 12, characterised in that the base electronic unit is able to cancel all the stored identification codes.

14. Safety apparatus for weapons according to claim 12, further comprising a programming transponder able to transmit a special programming code which lets the base electronic unit be in stand-by condition waiting for receiving a new identification code to be stored.

15. Safety apparatus for weapons according to claim 13, further comprising a cancellation transponder adapted to transmit a special cancellation code causing the cancellation of all identification codes stored in the base electronic unit.

16. Safety apparatus for weapons according to claim 12, characterised in that it provides one or more microswitches.

17. Safety apparatus for weapons according to claim 1, characterised in that the base electronic unit is further provided with a power switch.

18. Safety apparatus for weapons according to claim 17, characterised in that, when a transponder (5) transmitting an authorised identification code is within the transmission range of the base electronic unit, the safety mechanical device is released and the power switch is turned off, the control and processing central unit prevents the turning off of the base electronic unit until said transponder (5) does not exit from the transmission range of the base unit and the electromechanical transducer (2) does not reinstate the safety mechanical device.

19. Safety apparatus for weapons according to claim 1, characterized in that the control and processing central unit comprises a microprocessor.

20. The safety apparatus for weapons according to claim 1 in a weapon.

21. Electromechanical safety apparatus for weapons (1), provided with a mechanical safety device, comprising a base electronic unit, actuating an electromechanical transducer (2) acting on the safety mechanical device, and at least a transmitter—responder, or transponder (5), the base unit providing a central control and processing unit, connected with a transceiver unit (4), continuously transmitting an enquiry signal, able to talk with said at least one transponder (5), when the latter is within the transmission range of the transceiver unit (4), said at least one transponder (5) having no power supply and receiving the power necessary to its operation from the signal transmitted by the transceiver unit (4), said at least one transponder (5) transmitting, when supplied, an identification code, the base unit actuating the electromechanical transducer (2) in such a way to release the safety mechanical device when receives an identification code corresponding to a code stored into the base unit and actuating the electromechanical transducer (2) in such a way to insert the safety mechanical device as soon as the base unit no more receives said identification code, wherein the base electronic unit is provided with one or more rechargeable supply batteries, and wherein the charge level of the batteries is checked by the control and processing central unit in such a way that, in case the safety mechanical device is released and the voltage of the batteries falls to a threshold level still sufficient for the operation of the base unit and of the electromechanical transducer (2), said central unit activates a self-turning off circuit actuating the electromechanical transducer (2), so as to reinstate the safety mechanical device and then turns the base electronic unit off.

* * * * *